US007232345B2

(12) United States Patent
Ishizuka et al.

(10) Patent No.: US 7,232,345 B2
(45) Date of Patent: Jun. 19, 2007

(54) ELECTRICAL CONNECTOR USING A SUBSTRATE AS A CONTACTING MEMBER

(75) Inventors: Shinya Ishizuka, Tokyo (JP); Kazuyuki Ozai, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/168,183

(22) Filed: Jun. 28, 2005

(65) Prior Publication Data

US 2006/0003639 A1 Jan. 5, 2006

(30) Foreign Application Priority Data

Jun. 30, 2004 (JP) ..... 2004-192780

(51) Int. Cl.
*H01R 24/00* (2006.01)

(52) U.S. Cl. ..... 439/660

(58) Field of Classification Search ..... 439/497, 439/660, 579, 328, 59, 60, 62
See application file for complete search history.

(56) References Cited

U.S. PATENT DOCUMENTS 5,295,852 A * 3/1994 Renn et al. ..... 439/328
5,660,557 A * 8/1997 Lemke et al. ..... 439/328
5,954,521 A * 9/1999 Yang ..... 439/59
6,179,627 B1 * 1/2001 Daly et al. ..... 439/76.1
6,380,485 B1 * 4/2002 Beaman et al. ..... 174/88 R
6,565,366 B1 * 5/2003 Wu ..... 439/76.1
6,944,028 B1 * 9/2005 Yu et al. ..... 361/737
2003/0060086 A1 * 3/2003 Ozai ..... 439/660
2003/0064625 A1 * 4/2003 Ozai ..... 439/579

FOREIGN PATENT DOCUMENTS

JP H7-15106 1/1995
JP H10-32062 2/1998

* cited by examiner

*Primary Examiner*—Tho D. Ta
(74) *Attorney, Agent, or Firm*—Baker Botts LLP

(57) ABSTRACT

An electrical connector includes a housing, a substrate, and shielding plates. The housing has an inserting hole for the substrate, and the substrate has a plurality of signal patterns and a plurality of ground patterns alternately arranged on at least one surface of the substrate in a manner that one signal pattern is between two ground patterns. The signal patterns and the ground patterns each have a contact portion to contact a mating object and a connection portion to be connected to a cable. The shielding plates are each connected to the connection portion of the ground pattern for shielding. With this construction, the electrical connector achieves its miniaturization and reduction in crosstalk regardless of length of connected cables.

11 Claims, 4 Drawing Sheets

ELECTRICAL CONNECTOR USING A SUBSTRATE AS A CONTACTING MEMBER

CROSS-REFERENCE TO RELATED APPLICATIONS

This application claims priority from Japanese Patent Application No. 2004-192780, filed Jun. 30, 2004, which is incorporated by reference in its entirety.

BACKGROUND OF THE INVENTION

This invention relates to an electrical connector for use in electric or electronic appliances such as servers, super computers and the like, and more particularly to an improved electrical connector capable of minimizing crosstalk when being connected to cables.

In recent years, with the miniaturization of electric or electronic appliances, the requirement of miniaturization for electrical connector has put more severe pressure on manufacturers of connectors. In many cases, generally, an electrical connector comprises insulators formed of electrically insulating materials and electric contacts formed of a conductive material. The electric contacts each comprise a contact portion to contact a mating object, a fixed portion to be fixed to the insulator and a connection portion to be connected to a substrate or a cable. The electric contacts are fixed to the insulator by press-fitting, hooking (lancing) or the like.

As pitches of electric contacts have become progressively narrower, flexible printed boards or patterns on substrates have been used as contact portions or connection portions instead of pluralities of electric contacts as disclosed in the following Patent Literature 1. Moreover, there has been proposed to connect a rigid printed board and a flexible printed board directly to each other as disclosed in the following Patent Literature 2.

Japanese Patent Application Opened No. H10-32,062 (1998) (Patent Literature 1) discloses a substrate and the like used as contact portions or connection portions instead of electric contacts. This opened application has an object to provide an electrical connector whose connectors provided on each of substrates can be fitted with each other regardless of positional shifting (of the order of 0.5 mm) between the substrates. For this purpose, an insulator is provided with means for holding and fixing electric contacts which are flexible. Disclosed are electric contacts constructed by attaching two contact members to each other, the contact members each having conductors interposed between an insulating layer A and an insulating layer B. In other words, flexible printed circuit boards are used as the contact members to increase floating when connectors are being fitted with each other.

The invention disclosed in Japanese Patent Application Opened No. H7-15,106 (1995) (Patent Literature 2) has an object to prevent degrading of electric characteristics such as deterioration in signal when rigid and flexible boards are directly connected. For this purpose, in contact patterns consisting of narrow patterns in the case that the rigid and flexible boards are directly connected, ground patterns are arranged at a rate of one ground pattern per n signal patterns. With such arrangement, impedance of the ground patterns is stabilized to minimize the influence of noise and static electricity, and to reduce deterioration in signals due to crosstalk noise between signal patterns, thereby preventing the deterioration of electric characteristics. In other words, the n signal patterns and the ground patterns are arranged in a manner that n signal patterns are interposed between the ground patterns, thereby stabilizing the impedance.

In recent years, with the miniaturization of electric and electronic appliances, the requirement for miniaturization of electrical connectors has put more severe pressure on manufacturers of connectors, resulting in the rapid promotion of small and light type connectors. With high speed transmission (speeding up of signal speeds), reduction in crosstalk has become absolutely necessary.

The invention disclosed in the Patent Literature 1 intends to increase the floating when the connectors are fitted, by using the flexible printed boards. In this invention, however, the connection portions are of the surface mounting type (SMT) and not to be connected to cables, and there is no distinction between the signal and ground lines. Moreover, the invention in the Patent Literature 1 does not intend to stabilize the impedance and reduce the crosstalk either.

The invention disclosed in the Patent Literature 2 intends to stabilize the impedance of contact patterns by arranging the ground patterns at a rate of one ground pattern per n signal patterns. Such a feature does not reduce the crosstalk.

SUMMARY OF THE INVENTION

It is an object of the invention to provide an improved electrical connector which, in view of the problems of the prior art described above, achieves the miniaturization of the connector, and stabilization of impedance, and accomplishes the reduction in crosstalk regardless of length of connected cables.

This object of the invention can be achieved by an electrical connector according to the invention comprising a housing 12, a substrate 14, and shielding plates 16, the housing having an inserting hole 30 for the substrate 14, the substrate having a plurality of signal patterns 20 and a plurality of ground patterns 22 alternately arranged on at least one surface of the substrate in a manner that one signal pattern 20 is between two ground patterns 22, the signal patterns and the ground patterns each having a contact portion 26 to contact a mating object and a connection portion 28 to be connected to a cable, and the shielding plates 16 each connected to the connection portion 28 of the ground pattern 22 for shielding.

In a preferred embodiment, a plurality of signal patterns 20 and a plurality of ground patterns 22 are alternately arranged on both the surfaces of the substrate 14 in a manner that one signal pattern 20 is between two ground patterns 22, and the shielding plates 16 of a substantially U-shape are each connected to the connection portion 28 of the ground pattern 22.

In another embodiment, the substrate 14 is provided with anchoring portions 24 at predetermined positions on both sides of the longitudinal direction of the substrate 14, and locking members 18 each having an engagement portion 42 adapted to engage in the anchoring portion 24 are fixed to the housing 12. Preferably, the locking members 18 are substantially U-shaped.

The shielding plates 16 are preferably 0.2 mm to 1.5 mm higher than the surface of the substrate 14 when the shielding plates have been connected to the substrate. If the shielding plates extend less than 0.2 mm from the surface of the substrate, the crosstalk is not reduced. On the other hand, if it is more than 1.5 mm, the miniaturization of the connector could not be achieved.

As can be seen from the explanation described above, the electrical connector 10 according to the invention can bring about the following significant effects.

(1) The electrical connector according to the invention comprises a housing 12, a substrate 14, and shielding plates 16, the housing having an inserting hole 30 for the substrate 14, the substrate having a plurality of signal patterns 20 and a plurality of ground patterns 22 alternately arranged on at least one surface of the substrate in a manner that one signal pattern 20 is between two ground patterns 22, the signal patterns and the ground patterns each having a contact portion 26 to contact a mating object and a connection portion 28 to be connected to a cable, and the shielding plates 16 each connected to the connection portion 28 of the ground pattern 22 for shielding. It is, therefore, possible to miniaturize the connector 10 to the fullest extent and to achieve the reduction in crosstalk regardless of lengths of cables to be connected.

(2) According to the invention, a plurality of signal patterns 20 and a plurality of ground patterns 22 are alternately arranged on both the surfaces of the substrate 14 in a manner that one signal pattern 20 is between two ground patterns 22, and the shielding plates 16 of a substantially U-shape are each connected to the connection portion 28 of the ground pattern 22. With this construction, simultaneously with the miniaturization of the electrical connector 10, the shielding plates 16 can be easily connected to the connector without increasing the number of parts so that about 25% of the crosstalk can be reduced in comparison with those in the prior art, even if there are variations in frequency, height of shielding plates 16 and pitches of signal patterns 22.

(3) According to the invention, the substrate 14 is provided with anchoring portions 24 at predetermined positions on both sides of the longitudinal direction of the substrate 14, and locking members 18 each having an engagement portion 42 adapted to engage in the anchoring portion 24 are fixed to the housing 12. Therefore, the substrate 14 is used as a part adapted to contact mating objects to make possible to miniaturize the electrical connector 10, and the substrate 14 can be securely fixed to the housing 12 to obtain the stable connection.

(4) According to the invention, the locking members 18 are substantially U-shaped. The substrate 14 can be securely fixed to the housing 12 without increasing the number of parts, thereby achieving the stable connection.

(5) According to the invention, the shielding plates 16 are preferably 0.2 mm to 1.5 mm higher than the surface of the substrate 14 when the shielding plates have been connected to the substrate. With such an arrangement, about 25% of crosstalk can be reduced in comparison with those in the prior art, even if there are variations in frequency, height of shielding plates 16 and pitches of signal patterns 22, and the requirement for miniaturization can be achieved.

The invention will be more fully understood by referring to the following detailed specification and claims taken in connection with the appended drawings.

DESCRIPTION OF THE PREFERRED EMBODIMENTS

Figure 1A:
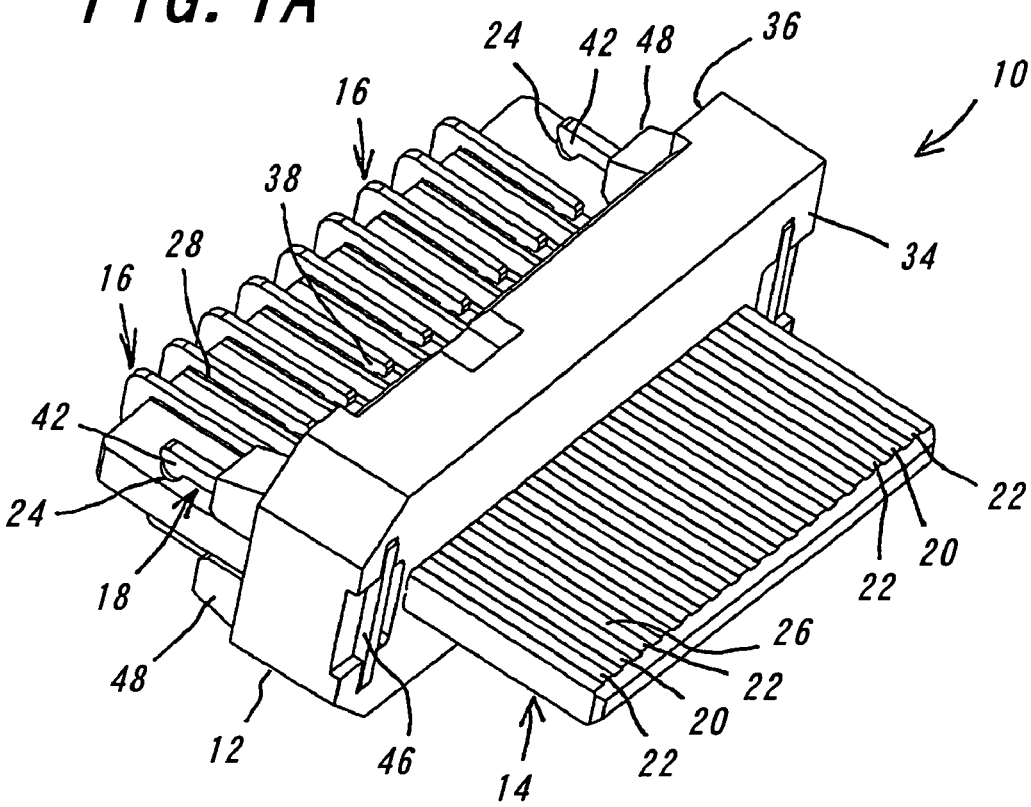
FIG. 1A is a perspective view of the electrical connector according to the invention viewed from its fitting side.
Figure 1B:
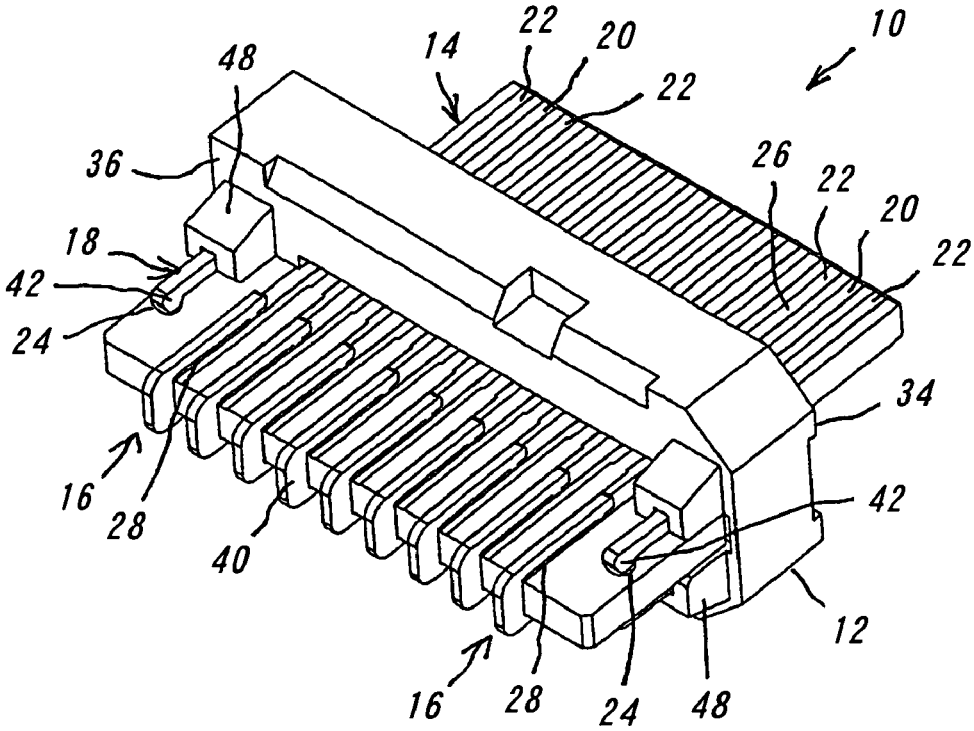
FIG. 1B is a perspective view of the electrical connector shown in FIG. 1, viewed from its connecting side.
Figure 2:
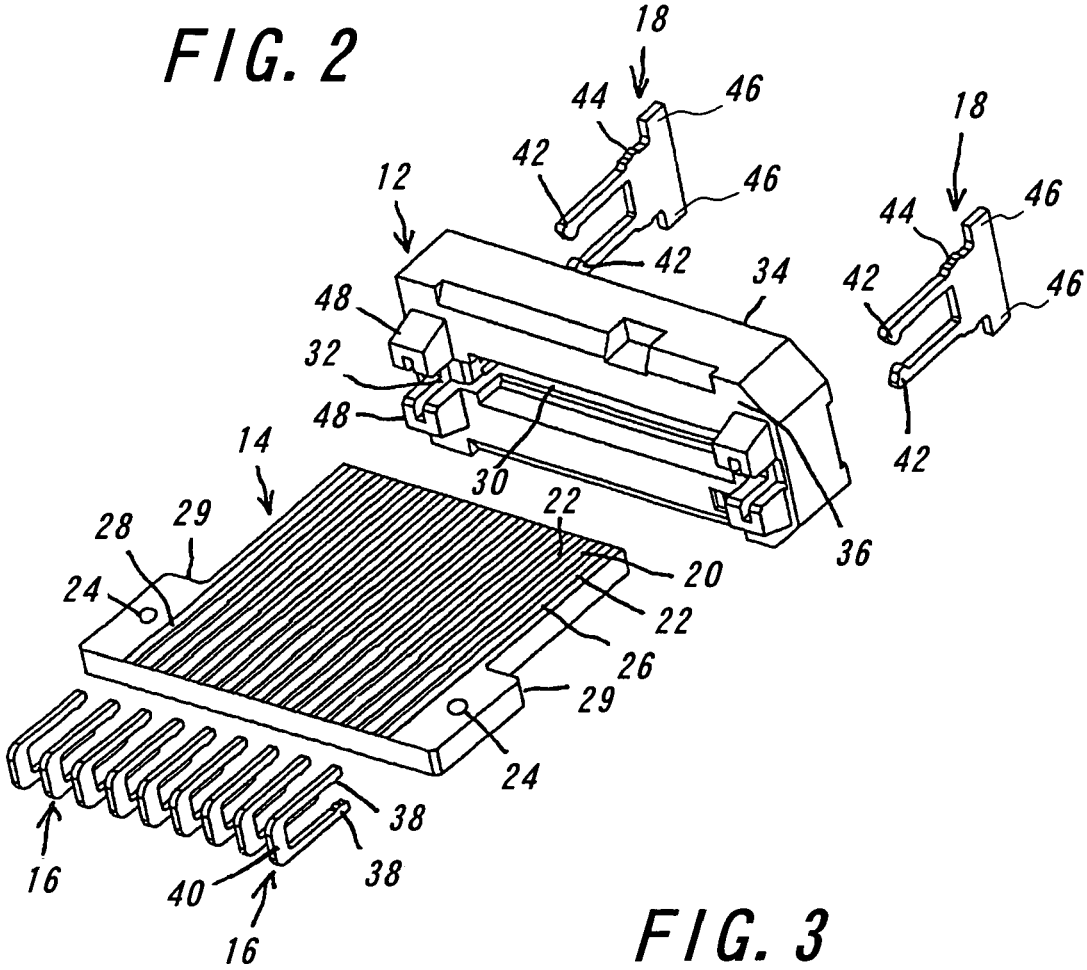
FIG. 2 is an exploded view of the electrical connector viewed from the connecting side.
Figure 3:
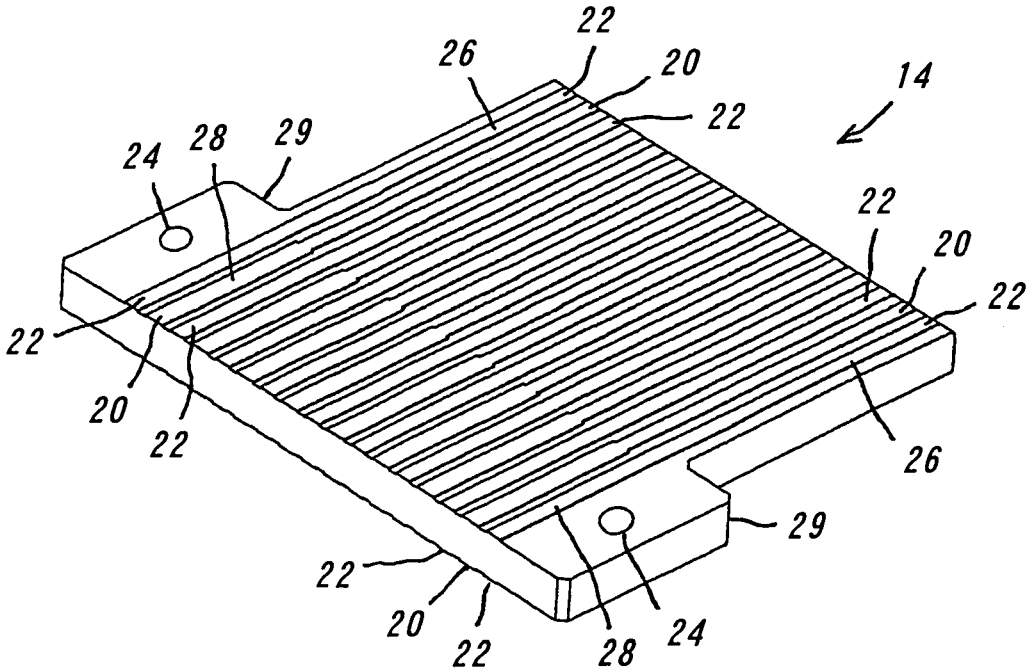
FIG. 3 is a perspective view of the substrate used in the connector shown in FIG. 1.
Figure 4:
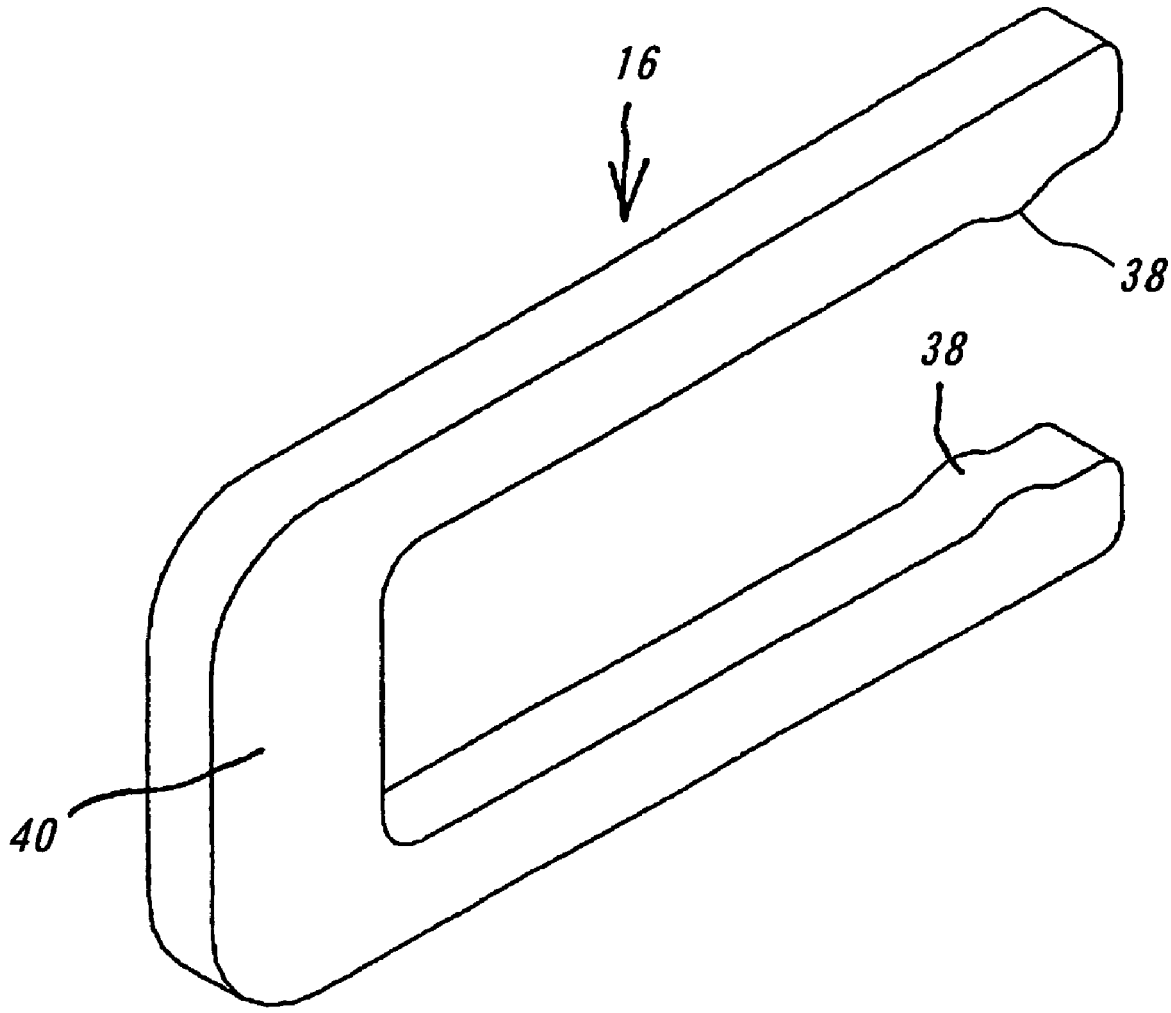
FIG. 4 is a perspective view of the shielding plate used in the connector shown in FIG. 1.
Figure 5:
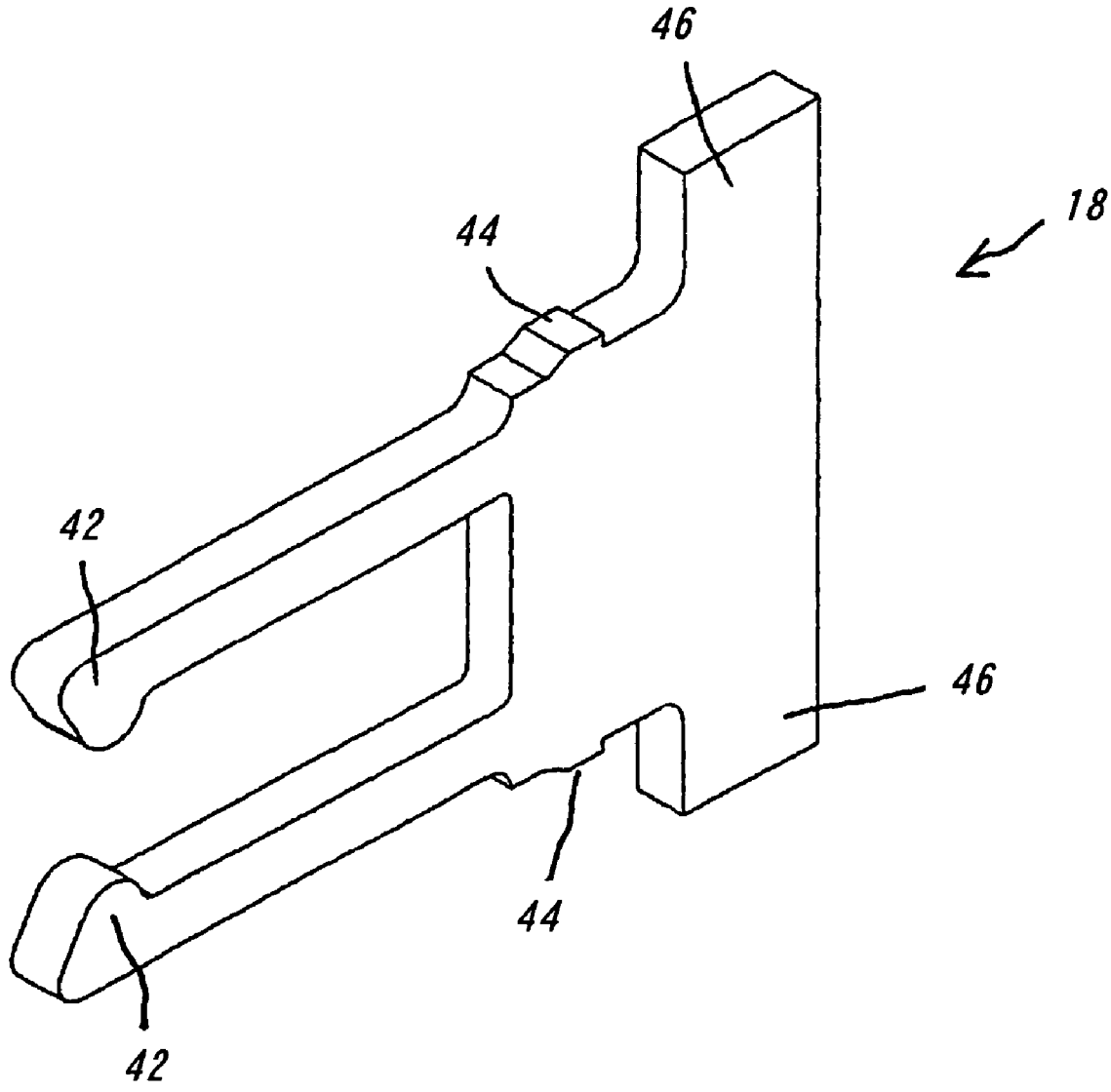
FIG. 5 is a perspective view of the locking member used in the connector shown in FIG. 1.

One embodiment of the electrical connector 10 according to the invention will be explained with reference to FIGS. 1 to 5 hereinafter. FIG. 1A is a perspective view of the electrical connector of the invention viewed from its fitting side, and FIG. 1B is a perspective view of the connector viewed from the connecting side. FIG. 2 is an exploded perspective view of the connector viewed from the connecting side. FIGS. 3, 4 and 5 are perspective views of the substrate, shielding plate and locking member used in the electrical connector according to the invention, respectively.

The electrical connector 10 of the one embodiment according to the invention mainly comprises a housing 12, a substrate 14, shielding plates 16 and locking members 18. In the electrical connector 10, instead of electric contacts, the substrate 14 is used as a contacting members in contact with mating objects in order to achieve a narrower pitch and hence a miniaturization of the connector 10.

First, the substrate 14 will be explained, which is one subject feature of the invention. In general, an electrical connector uses electric contacts for exchanging signals. In the present invention, instead of electric contacts, a substrate 14 is used. The substrate 14 comprises signal patterns 20 and ground patterns 22, each having a contact portion 26 adapted to contact a mating object, and a connection portion 28 to be connected to a cable or the like. As shown in FIG. 3, the substrate 14 is substantially in the form of a T-shape and has steps or shoulders 29 on opposite sides of the longitudinal direction for positioning the substrate in relation to the housing 12 when the substrate is inserted thereinto. The signal patterns 20 and the ground patterns 22 alternately arranged in a manner that the signal pattern 20 is arranged between the ground patterns 22. Arranging the signal pattern 20 between the ground patterns 22 provides shielding effect, thereby achieving stabilization of impedance. In the illustrated embodiment, the signal patterns 20 and the ground patterns 22 are provided on both the surfaces of the substrate. However, they may be provided on either of the both the surfaces of the substrate depending upon specification or customers demands.

The size of the substrate 14 may be suitably designed in consideration of desired specification, miniaturization of connector and strength of substrate. In the illustrated embodiment, as the pitch of the signal patterns is 1.5 mm, the substrate is 16.8 mm in length, 14 mm in width and 1.2 mm in thickness. The substrate 14 is provided on both the sides of the longitudinal direction with anchoring portions 24 adapted to engage engagement portions 42 of the locking members 18 as shown in FIG. 3. The shape of the anchoring portions 24 may be any shape insofar as the anchoring portions 24 can engage the engaging portions 42 of the locking members 18. The anchoring portions 24 are through-holes in the illustrated embodiment as shown in FIG. 3, but may be U-shaped recessed (not shown) or may be blind holes according to specifications or customers demands.

The shielding plates 16 will be explained, which are another subject feature of the invention. The shielding plates 16 are formed by the known press-working from a metal. Preferred metals from which to form the shielding plates 16 include brass, beryllium copper, phosphor bronze and the like to fulfil the requirements imposed thereon such as springiness, conductivity and the like.

The mere arrangement of the signal patterns 20 between the ground patterns 22 does not remarkably contribute to the reduction in crosstalk. According to the invention, the shielding plates 16 are connected to the connection portions 28 of the ground patterns 22 on the substrate 14 to reduce the crosstalk. Moreover, the reduction in the crosstalk can be varied by changing the height (extending distance) of the shielding plates 16 from the surface of the substrate 14. The shape of the shielding plates 16 may be suitably designed according to demanded specifications of the substrate 14 and strength of the shielding plates 16. As the substrate 14 is provided with patterns on both the sides in the illustrated embodiment, the shielding plates 16 are in the form of a substantially U-shape as shown in FIG. 4. In more detail, the shielding plates 16 each have pattern connection portions 38 opposite to each other and adapted to be connected to the connection portions 28 of the ground patterns 22 in a manner embracing the substrate 14. The respective pattern connection portions 38 and a connection portion 40 may form an integral U-shape. The pattern connection portions 38 are in the form of a protrusion having curved edges in order to be easily connected to the respective ground patterns 22.

The size of the shielding plates 16 may be designed in consideration of reduction in crosstalk when cables are connected and miniaturization of the connector. The shielding plates 16 are designed so as to extend 0.2 to 1.5 mm from the surface of the substrate 14. If the shielding plates 16 extend less than 0.2 mm from the surface of the substrate 14, the crosstalk is not reduced. On the other hand, if it is more than 1.5 mm, the miniaturization of the connector could not be achieved. In consideration of these facts, the extending height of the shielding plates from the substrate is determined to be 0.4 mm in the illustrated embodiment.

The shielding plated 16 in the form of U-shape as in the embodiment may be used even if the patterns are provided only on either surface of the substrate. However, the shielding plates may be designed in the form enabling to be connected only to the surface of a substrate provided with patterns only on its one surface. For example, a plate-shaped piece having a pattern connection portion (not shown) may be conceived.

In order to connect the shielding plates 16 to the substrate 14, various methods may be used such as soldering, welding, weld depositing, simple embracing or the like.

The housing 12 will then be explained. The housing 12 is injection-molded from an electrically insulating plastic material in the conventional manner. Preferred materials from which to form the housing 12 include polybutylene terephthalate (PBT), polyamid (66 PA or 46 PA), liquid crystal polymer (LCP), polycarbonate (PC) and the like and combinations thereof in view of the requirements imposed on the housing 12 with respect to dimensional stability, workability, manufacturing cost and the like.

The housing 12 is formed with an inserting hole 30 into which the substrate 14 is inserted. The substrate 14 is fixed to the housing by press-fitting, hooking (lancing) (including means with other part) or the like. The fixing method may be designed in consideration of the strength of the substrate, positional accuracy, holding force and the like. However, it is most preferable to use the hooking using a separate part. In the illustrated embodiment, the locking members 18 as described later are inserted from the fitting side 34 of the connector into the housing to cause parts of the locking members 18 to be hooked in the anchoring portions 24 of the substrate 14, thereby fixing the substrate 14 to the housing 12.

The housing 12 is provided with altogether four projections 48 on both sides of the longitudinal direction of the housing on the connecting side 36. The two projections 48 on either side of the housing 12 are opposite to each other in the thickness direction of the housing (the vertical direction viewed in FIG. 2) and spaced apart from each other with a predetermined spacing. The steps or shoulders 29 of the substrate 14 are adapted to be accommodated in the spacing between the two projections on both the sides. The spacing between the opposite projections 48 may be suitably designed in consideration of the thickness of the substrate 14. In the illustrated embodiment, the spacing is approximately 0.2 mm larger than the thickness of the substrate 14. For positioning the substrate in the longitudinal direction relative to the housing, the housing is provided with a required number of crush ribs (not shown) on both sides in the inserting hole 30. In the illustrated embodiment, there are provided two crush ribs on each side, altogether four crush ribs with a view to obtaining their function to the fullest extent.

In view of the fact described above, the size of the inserting hole 30 in its longitudinal direction may be designed in consideration of shifting of the pitches of the patterns 20 and 22. In the illustrated embodiment, as there are provided the crush ribs in the inserting hole 30 described above, an operator will feel a certain counterforce when he is inserting the substrate into the inserting hole 30 like a slight press-fitting. As there is no positioning of the substrate in the direction of thickness, the height of the inserting hole 30 is 0.2 mm larger than the thickness of the substrate 14. The positioning of the substrate in the direction of thickness is achieved with the aid of the locking members 18 as described below.

Moreover, the housing 12 is formed with inserting grooves 32 extending therethrough from the fitting side 34 to the connecting side 36 in which the locking members 18 are fixed therein, respectively. The size of the inserting grooves 32 is suitably designed in consideration of the holding force of the locking members 18 for the substrate 14 and the strength of the housing 12. In the illustrated embodiment, the inserting grooves 32 are approximately 2.98 mm in height and 0.45 mm in width.

The locking members 18 will then be explained. The locking members 18 are formed by the known press-working from a metal. Preferred metals from which to form the locking members 18 include brass, beryllium copper, phosphor bronze and the like to fulfil the requirements imposed thereon such as dimensional stability, workability and the like.

The locking members 18 are inserted into the inserting grooves 32 of the housing 12 from the fitting side 34 by press-fitting and fixed thereto. The locking members 18 are in the form of a substantially U-shape as shown in FIG. 5 and each comprise the engagement portions 42 adapted to engage in the anchoring portions 24 of the substrate 14, respectively, fixing portions 44 for press-fitting into the housing and positioning portions 46 for positioning of the locking member and increasing its holding force.

The shape of the engagement portions 42 may be designed in consideration of the holding force and engagement property for the substrate 14 and may be any shape insofar as they can comply with these requirements. In the illustrated embodiments, the engagement portions 42 extend toward each other and are of a rounded R-shape. The size of the fixing portions 44 may be arbitrary insofar as they can be fixed to the inserting grooves 32 of the housing 12 by press-fitting. The positioning portions 46 serve to regulate inserted depth of the locking members 18 when they are inserted into the inserting grooves 32 of the housing 12 and further serve to prevent the substrate 14 from being removed onto the connecting side 36 when cables connected to the substrate 14 are subjected to excess external forces unintentionally. The size of the positioning portions 46 may be suitably designed in consideration of these functions and the strength of the housing 12.

As described above, the locking members 18 serve to position the substrate 14 in the direction of its thickness relative to the inserting hole 30 of the housing 12. Therefore, the distance between the two legs of the U-shaped locking member 18 is substantially the same as the thickness of the substrate 14 except for the engagement portions 42 extending from the legs of the U-shape toward each other.

Finally, the sequence of assembling of the electrical connector will be explained.

(1) First, the substrate 14 is inserted into the inserting hole 30 of the housing 12 from the connecting side 36.

(2) Then, the locking members 18 are inserted into the inserting grooves 32 of the housing 12 from the fitting side 34 to cause the engagement portions 42 of the locking members 18 to be engaged in the anchoring portions 24 of the substrate 14.

(3) Finally, the shielding plates 16 are forced onto the connection portions 28 of the ground patterns 22 of the substrate 14 from the connecting side 36, and the pattern connection portions 38 of the shielding plates 16 are connected to the connection portions 28 of the ground patterns 22 by soldering, respectively. A required number of cables are connected to the connection portions 28 of the signal patterns 20 of the substrate 14, respectively.

(4) If required, the electrical connector 10 according to the invention thus assembled is covered by an upper and a lower cover.

Examples of the application of the present invention are electrical connectors for use in electric or electrical appliances such as servers or super computers, and, particularly, electrical connectors connected to cables and to be required to minimize the crosstalk.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector using a substrate as a contacting member in contact with mating objects comprising a housing, a substrate, and shielding plates, said housing having an inserting hole for said substrate, said substrate having a plurality of signal patterns and a plurality of ground patterns alternately arranged on at least one surface of the substrate in a manner that one signal pattern is between two ground patterns, said signal patterns and said ground patterns each having a contact portion to contact a mating object and a connection portion to be connected to a cable, said shielding plates each connected to said connection portion of said ground pattern for shielding, wherein said shielding plates are substantially U-shaped and extend to a height above the surface of the substrate sufficient to shield cross-talk between adjacent signal patterns, wherein said substrate is provided with anchoring portions at predetermined positions on both sides of the longitudinal direction of said substrate, and substantially U-shaped locking members each having an engagement portion adapted to engage in said anchoring portion are fixed to said housing; and wherein said locking members serve to position said substrate in the direction of its thickness relative to said inserting hole of said housing.

2. The electrical connector as set forth in claim 1, wherein said shielding plates are 0.2 mm to 1.5 mm higher than the surface of said substrate when said shielding plates have been connected to the substrate.

3. The electrical connector as set forth in claim 1, wherein said shielding plates are 0.2 mm to 1.5 mm higher than the surface of said substrate when said shielding plates have been connected to the substrate.

4. The electrical connector as set forth in claim 1, wherein said shielding plates are 0.2 mm to 1.5 mm higher than the surface of said substrate when said shielding plates have been connected to the substrate.

5. The electrical connector as set forth in claim 1, wherein said shielding plates are 0.2 mm to 1.5 mm higher than the surface of said substrate when said shielding plates have been connected to the substrate.

6. The electrical connector as set forth in claim 1, wherein said shielding plates are 0.2 mm to 1.5 mm higher than the surface of said substrate when said shielding plates have been connected to the substrate.

7. The electrical connector as set forth in claim 1, wherein a plurality of signal patterns and a plurality of ground patterns are alternately arranged on both the surfaces of said substrate in a manner that one signal pattern is between two ground patterns, and said shielding plates of a substantially U-shape are each connected to said connection portion of said ground pattern.

8. The electrical connector as set forth in claim 7, wherein said shielding plates are 0.2 mm to 1.5 mm higher than the surface of said substrate when said shielding plates have been connected to the substrate.

9. The electrical connector as set forth in claim 7, wherein said shielding plates are 0.2 mm to 1.5 mm higher than the surface of said substrate when said shielding plates have been connected to the substrate.

10. The electrical connector as set forth in claim 7, wherein said shielding plates are 0.2 mm to 1.5 mm higher than the surface of said substrate when said shielding plates have been connected to the substrate.

11. The electrical connector as set forth in claim 7, wherein said shielding plates are 0.2 mm to 1.5 mm higher than the surface of said substrate when said shielding plates have been connected to the substrate.

* * * * *